US007789033B2

(12) United States Patent
Doig et al.

(10) Patent No.: US 7,789,033 B2
(45) Date of Patent: Sep. 7, 2010

(54) PORTABLE BOAT MOORING SYSTEM

(75) Inventors: Thomas Steven Doig, West Bend, WI (US); Tracy J. Sommer, Cedarburg, WI (US)

(73) Assignee: White Bear LLC, West Bend, WI (US)

( * ) Notice: Subject to any disclaimer, the term of this patent is extended or adjusted under 35 U.S.C. 154(b) by 0 days.

(21) Appl. No.: 12/325,048

(22) Filed: Nov. 28, 2008

(65) Prior Publication Data

US 2009/0139439 A1 Jun. 4, 2009

Related U.S. Application Data

(60) Provisional application No. 61/004,557, filed on Nov. 29, 2007.

(51) Int. Cl.
*B63B 21/00* (2006.01)

(52) U.S. Cl. ..... 114/230.17; 114/230.15

(58) Field of Classification Search ..... 114/218, 114/230.1, 230.11, 230.2, 230.22, 230.24–230.27, 114/230.15–230.19
See application file for complete search history.

(56) References Cited

U.S. PATENT DOCUMENTS

| | | | | | |
|---|---|---|---|---|---|
| 2,938,492 | A * | 5/1960 | Kulick | 114/230.18 |
| 3,157,150 | A * | 11/1964 | Faber, Jr. | 114/230.18 |
| 3,183,877 | A * | 5/1965 | Benzel | 114/230.15 |
| 3,464,214 | A * | 9/1969 | King | 405/214 |
| 3,492,963 | A * | 2/1970 | Kaiser | 114/230.16 |
| 5,036,787 | A | 8/1991 | Rogers | |
| 5,154,132 | A | 10/1992 | Brushaber | |
| 5,243,926 | A | 9/1993 | Wright et al. | |
| 5,282,434 | A | 2/1994 | Hart et al. | |
| 5,542,367 | A * | 8/1996 | DuBois et al. | 114/218 |
| 5,575,234 | A * | 11/1996 | Dysarz | 114/230.27 |
| 5,603,682 | A * | 2/1997 | Grider | 482/142 |
| 6,578,509 | B1 | 6/2003 | Brushaber | |
| 7,032,529 | B2 | 4/2006 | Sanford | |
| 2004/0007168 | A1 * | 1/2004 | Metz | 114/230.16 |

OTHER PUBLICATIONS www.safeharbormarine.com; Safe Harbor Marine, Inc.; last accessed Nov. 10, 2008.

www.moor-king.com; Moor-King Mooring System; last accessed Nov. 10, 2008.

(Continued)

*Primary Examiner*—Edwin Swinehart
(74) *Attorney, Agent, or Firm*—Boyle Fredrickson, S.C.

(57) ABSTRACT

A portable boat mooring system is provided that includes a base removably or non-removably attached to a pier. An arm assembly can extend from the base outwardly beyond an edge of the pier. A mooring line that has a resiliently flexible portion thereof attaches a boat to the system while mooring the boat to the pier and maintaining a space therebetween. A tool-less hardware assembly can be utilized which allows users to manually install the base to the pier while they remain on top of the pier or above an upper surface of the pier during the entire installation. An anchoring device can selectively hold the mooring line at a predetermined length or state of tension.

9 Claims, 5 Drawing Sheets

OTHER PUBLICATIONS www.consumersmarine.com_modperl_product browse; Consumers Marine; last accessed Nov. 10, 2008.

www.taylormadeproducts.com_news_031805; Taylor Made Products Introduces Boatguard Mooring Whips; last accessed Nov. 10, 2008.

www.stowawayholdaway.com; Stowaway Holdaway; last accessed Nov. 10, 2008.

www.wakewatchers1.com; Wake Watchers Mooring Systems; last accessed Nov. 10, 2008.

* cited by examiner

PORTABLE BOAT MOORING SYSTEM

CROSS REFERENCE TO RELATED APPLICATIONS

This application claims priority from U.S. Provisional Patent Application Ser. No. 61/004,557, filed on Nov. 29, 2007, the entirety of which is expressly incorporated by reference herein for all purposes.

BACKGROUND OF THE INVENTION

1. Field of the Invention

This invention relates to boating and, more particularly, to boat mooring devices and systems.

2. Discussion of the Related Art

Mooring boats and/or other watercraft is a necessary task associated with use of such boat and/or watercraft, hereafter referred to collectively as "boats". When boats are moored to, e.g., piers, the boats can rub into or otherwise contact the piers. This can scratch, scuff, or otherwise damage the boat, the pier, or both the boat and the pier. Numerous attempts have been made to protect boats and/or piers from such mooring related damage.

Some known attempts to resolve mooring-related damage include using devices that hang from the boats themselves. These devices are commonly referred to as fenders or bumpers and are large, usually cylindrical, cushions made from polymeric materials. The fenders are tied to cleats on the boats and hung between the boats and the pier.

However, it can at times prove difficult to tie the fenders at appropriate heights so that they are properly aligned with a pier. Even when the fenders are initially properly aligned with the pier, moored boats tend to move as permitted by the mooring ropes or lines and as influenced by, e.g., waves, wind, and/or other factors. As waves, wind, and/or other factors cause moored boats to drift, pitch, roll, or otherwise move, the fenders can become misaligned with the piers, leaving the boats vulnerable to mooring related damage. Due to exposure to ultraviolet radiation, water, and organisms that live in the water, the fenders can fade, stain, or otherwise become less aesthetically pleasing over time. Some fenders are also relatively bulky items that, when being stored on boats, occupy otherwise usable storage space. Furthermore, at times when boats collide with piers with a lot of force, fenders may prevent impact-type damage to the boats but may also leave scuffs or other marks on the boats.

Other known attempts to reduce instances of mooring-related damage include using devices that are mounted to piers. Like the above-discussed fenders that hang from boats, some devices directly absorb impacts between the boats and piers. These pier-mounted impact absorbers are commonly referred to as dock bumpers. Dock bumpers are typically made from polymeric materials and can be, e.g., elongate and attached to outwardly facing surfaces of the pier, or configured to wrap at least partially around pier support posts or legs.

However, dock bumpers only protect boats from collisions between the boats and the particular pier surfaces that the dock bumpers cover, whereby pier surfaces that remain uncovered can still potentially damage boats, if the boats collide therewith. Like boat fenders, dock bumpers are also subjected to ultraviolet radiation, water, and organisms that live in the water, whereby the dock bumpers can fade, stain, or otherwise become less aesthetically pleasing over time. Furthermore, if boats collide with piers with a lot of force, the dock bumpers may prevent impact-type damage to the boats but may also leave scuffs or other marks on the boats.

Yet other attempts have been made to reduce instances of mooring-related damage by incorporating pier mounted but non-impact absorbing devices. Exemplary of such devices are those commonly referred to as mooring whips. Mooring whips can connect a boat to a pier while maintaining a distance therebetween. In other words, mooring whips prevent boats from hitting piers, to which they are moored.

Typical mooring whips are elongate flexible members that are made from, e.g., fiberglass or other flexible materials. One end of the whip is attached to the pier, by hard mounting, and the other end is attached to a boat by way of, e.g., rope or other marine-type line. As waves, wind, and/or other factors cause moored boats to drift, pitch, roll, or otherwise move, the mooring whips bend to accommodate such movement. The bent mooring whips try to restore themselves to their respective default configurations, urging the boat away from the pier and ensuring that that it does not collide with the pier.

However, mooring whips can be quite long and somewhat clumsy to manipulate while connecting a boat to and releasing a boat from a pier. Their length and flexible material characteristics can also make them awkward to remove from the pier, for example, when it is desired to store the mooring whips, and require large storage spaces when storing them. Due to their size and since they are hard mounted to piers, relocating, remounting, or transporting mooring whips can be quite laborious.

Some attempts have been made to provide mooring devices that are made of rigid, for example, metallic, materials instead of flexible like those used in mooring whips. U.S. Pat. No. 5,282,434 discloses such mooring devices. The mooring devices are mounted to a pier and include an upright post and an arm that is hinged to the top of the post. A first end of the arm extends over the water and attaches to a boat with a rope or marine line. A second end of the arm extends away from the water, over the pier surface. A spring attaches to the second end to a base portion. In this configuration, when the moored boat drifts, pitches, rolls, or otherwise moves, it may pull the first end of the arm downwardly toward the water. The spring then urges the first end back up toward its resting state position, generally maintaining the boat in its moored position.

However, such spring biased rigid arm mooring devices are relatively large and bulky. For example, the second end of the arm and the spring occupy otherwise usable space on the pier. It is also noted that occupying space on a pier with moving device components, such as the up and downwardly pivoting second arm end, can at times be objectionable for pier occupants or users. Furthermore, due to size and hard-mounted configuration, relocating, remounting, or transporting spring biased rigid arm mooring devices can be quite laborious.

SUMMARY OF THE INVENTION

It could prove desirable to provide a mooring system that overcomes the abovementioned drawbacks of the prior art. For example, it could prove desirable to provide a mooring system that occupies a relatively small surface area on a pier to which it is mounted. It could prove desirable to provide a mooring system that is collapsible and readily portable, can be easily stowed in a boat, or is otherwise easily storable. It could further prove desirable to provide a mooring system that can be fully installed, fully uninstalled, and fully adjusted by hand without requiring the use of any tools or ancillary hardware.

In accordance with a first aspect of the present invention, a portable boat mooring system includes a base removably attached to a pier. The boat mooring system may include an arm assembly extending from the base outwardly beyond an edge of the pier. A mooring line is connected to and extends beyond the arm assembly. The mooring line has an end that attaches to the boat for securing the boat to the pier while maintaining a space between the boat and the edge of the pier. At least a portion of the mooring line can be resiliently flexible such that the portion of the mooring line is capable of elongating and contracting to accommodate wave induced or user induced movement of the boat while the boat is secured to the pier.

The mooring line of the present invention may include an elastic assembly that defines the resiliently flexible portion of the mooring line. The elastic assembly may be positioned between a lower non-elastic portion of the mooring line that is attached to the boat and an upper non-elastic portion that is anchored to at least one of the arm assembly and the base. The mooring line may be selectively anchored to at least one of the arm assembly and the base without requiring manual tying of the mooring line thereto.

The mooring system may further include a cam buckle. The cam buckle anchors the mooring line to at least one of the arm assembly and the base. The cam buckle is configured to hold the mooring line in a state of tension.

In some embodiments, the mooring system of the present invention may further include a loop attached to the lower arm. The cam buckle may be mounted to the lower arm and aligned with the loop such that the mooring line extends through the cam buckle and the loop in series with one another. The loop may be configured to redirect the mooring line such that a pulling force that pulls a first segment of the mooring line in a first direction correspondingly pulls a second segment of the mooring line through the cam buckle in a second and different direction.

The mooring system may further include a ratchet assembly. The ratchet assembly is configured for selectively anchoring the mooring line to at least one of the arm assembly and the base. The ratchet assembly is configured to retain the mooring line in tension.

In some implementations, the arm assembly of the mooring system may have a variable length. The arm assembly may further include a lower arm that can pivot with respect to an upper surface of the pier and an upper arm that is operably coupled to and longitudinally movable with respect to the lower arm. The upper arm may be received and moved telescopically with respect to the lower arm. The lower arm may include a thumbscrew for adjusting the length of the arm assembly by fixing a position of the upper and lower arms with respect to one another.

The base of the portable mooring system of the present invention may include a bottom wall sitting upon an upper surface of the pier. The base may also include a flange assembly attached to the bottom wall. An end of the lower arm may be pivotally mounted to the flange assembly. The bottom wall may also include longitudinally extending slots and transversely extending slots. The slots define a variable mounting depth and width, respectively. The slots facilitate mounting of the system to multiple pier decking planks that have different width dimensions. The bottom wall of the base may be removably attached to the pier by a tool-less hardware that extends through the longitudinal or transversely extending slots.

The tool-less hardware for attaching the base to the pier may include a threaded rod extending through the bottom wall of the base. The threaded rods includes a cap on an end thereof for manually rotating the threaded rod from above the upper surface of the pier and preventing non-desired rotation of the threaded rod from above the upper surface of the pier. A thumb nut engages the threaded rod such that tightening the thumb nut on the threaded rod clamps the bottom wall of the base against the pier. The threaded rod may include at least one projection that extends radially outward from an outer surface of the threaded rod. Rotating the threaded rod correspondingly rotates the projection for selectively engaging a lower surface of the pier. The projection may be insertable between adjacent pier decking planks to facilitate mounting of the portable boat mooring system entirely from above the surface of the pier.

The portable boat mooring system of the present invention may further include a locking collar. The locking collar cooperates with the flange for holding the arm assembly in a retracted position in which the arm assembly does not extend outwardly beyond the edge of the pier.

In another embodiment of the present invention, the portable boat mooring system includes a base removably attached to a pier. An arm assembly extends outwardly from the base and beyond an edge of the pier. A mooring line having an elastic assembly that resiliently elongates and contracts is connected to and extends beyond the arm assembly. A tensioning device anchors the mooring line to at least one of the base and the arm assembly. The tensioning device holds the mooring line in tension when the mooring line is attached to a boat. The tensioning device may include a cam buckle to hold the mooring line in tension.

Various alternative embodiments and modifications to the invention will be made apparent to one of ordinary skill in the art by the following detailed description taken together with the drawings.

BRIEF DESCRIPTION OF THE DRAWINGS

The drawings illustrate a preferred and exemplary embodiment of the invention.

In the drawings.

DETAILED DESCRIPTION OF THE PREFERRED EMBODIMENTS

The present invention and the various features and advantageous details thereof are explained more fully with reference to the non-limiting embodiments described in detail in the following description.

Figure 1:
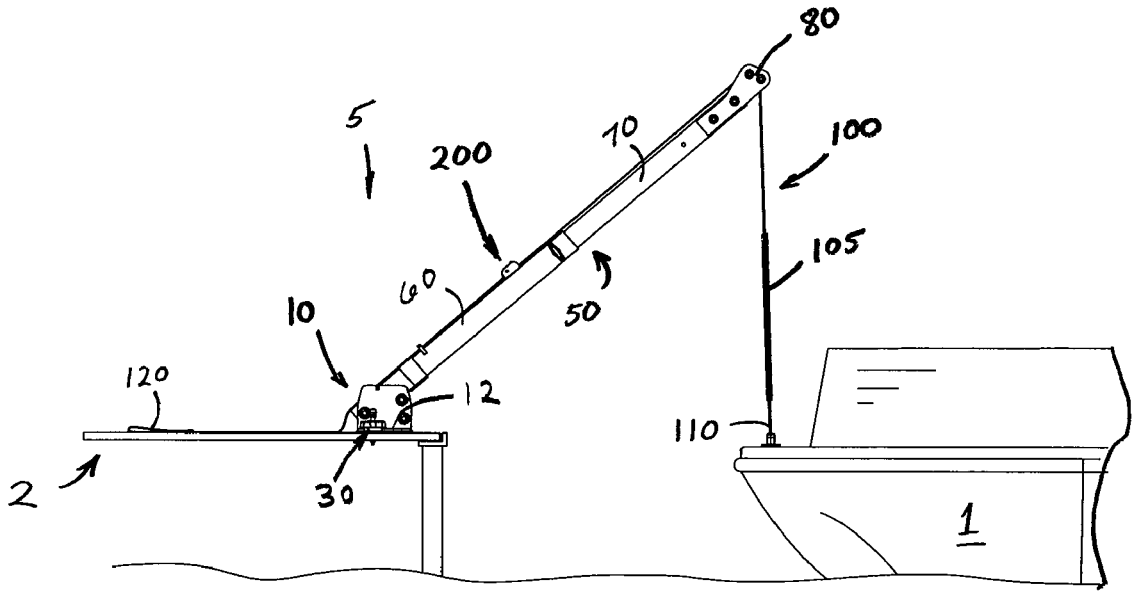
FIG. 1 is a pictorial view of an embodiment of a mooring system according to the invention, mounted to a pier.

Turning now to the drawings, FIG. 1 shows a portable boat mooring system, e.g., system 5, which is usable for mooring a boat 1 to a pier 2. Although described as being portable, it is fully appreciated that system 5 can be configured for, e.g., non-portable or permanent installations, as desired. Such installations and implementations are correspondingly well within the scope of the invention. System 5 is described as used with boat 1 for the sake of simplicity of description, noting that system 5 is fully usable with numerous other water-use vessels or accessories, such as, e.g., personal watercraft, rafts, skiffs and/or others, whereby such uses are also well within the scope of the invention.

Still referring to FIG. 1, system 5 is configured to position and hold boat 1 away from the pier 2. System 5 includes base 10, hardware assembly 20, arm assembly 50, mooring line 100, and anchoring device 200. Base 10 can be temporarily mounted to pier 2 for portable versions of system 5 or fixedly or hard mounted to pier 2 for permanent implementations of the system 5. The particular method of attaching system 5, and it's permanently or removably mounted characteristics, is determined at least in part by the particular configuration of hardware assembly 20. Arm assembly 50 attaches, preferably movably, to base 10 and can adjustably cooperate with mooring line 100 for at least partially establishing various use characteristics such as mooring line 100 height with respect to the water, outwardly beyond an edge of pier 1, and/or others.

System 5 is adaptable to accommodate different design features of different boats 1, different design features of different piers, or other implementation specific characteristics. In other words, system 5 is configured to accommodate a wide range of boat lengths, widths, heights, and materials (e.g. fiberglass, wood, or aluminum, and others) and can be mounted to almost any conventional dock or pier 1, including but not limited to, any of a variety of floating docks and piers, as well as solid docks and piers 1. In light of such functionality, system 5 can adapt for use with a variety of dock and pier scenarios, as well as variations in dock and pier heights as it relates to the height of the boat in relation to the height of the dock or pier.

Regardless, the system 5 is configured to hold and maintain boat 1 in a spaced relationship with respect to pier 2, to prevent the boat 1 from undesirably contacting the pier 2. Of course, system 5 also maintains boat 1 in relatively close proximity to pier 2, holding the boat by a cleat or otherwise so that it remains suitably moored to the pier 2. It is noted that in typical implementations, multiple units of system 5 are incorporated to hold and restrain boat 1 at multiple locations along its length. For example, a first system 5 can be used to secure a bow or forward end of boat 1 and a second system can be used to secure a stem or aft end of the boat 1.

Figure 2:
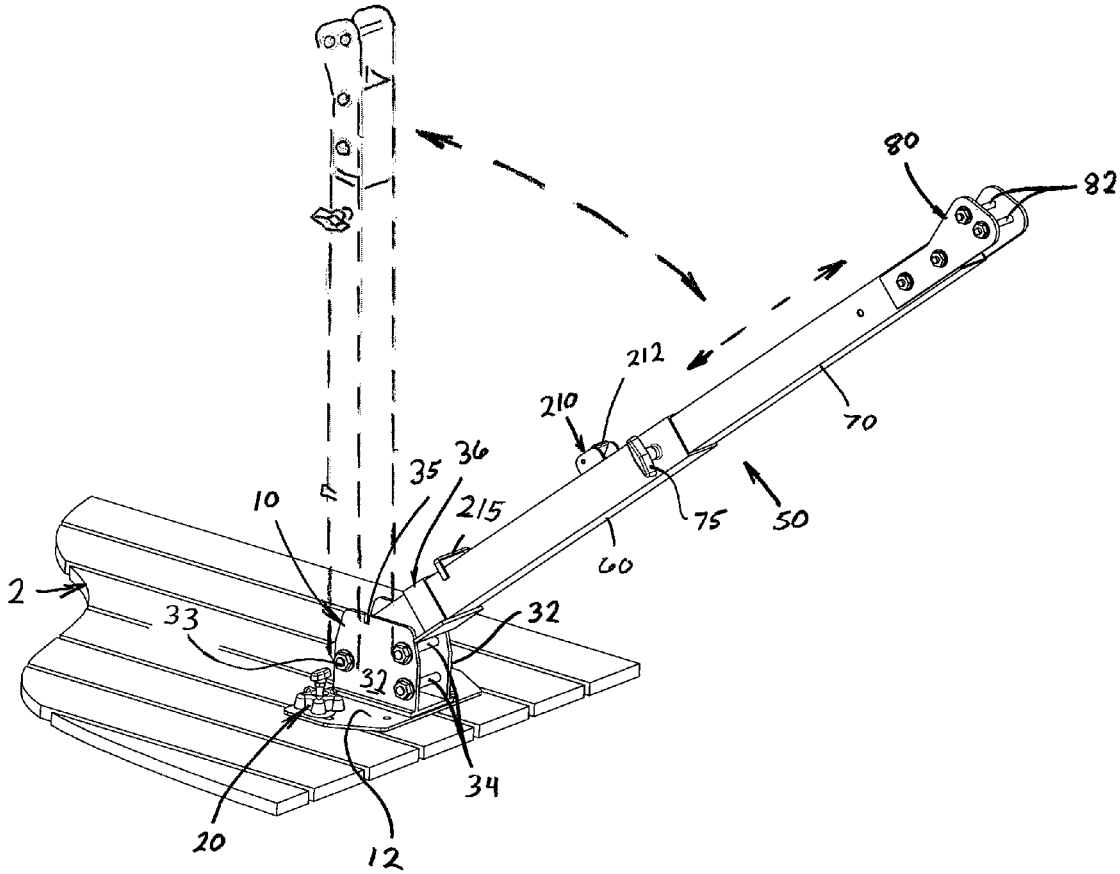
FIG. 2 is a pictorial view of an embodiment of a base used with the mooring system of FIG. 1.

Referring now to FIGS. 1 and 2, system 5 can define (i) an in-use, mooring configuration or extended position, (ii) a retracted position, and (iii) a collapsed or stored position. While positioned in any of the numerous different use and/or storage positions, system 5 is configured to occupy a relatively small footprint upon or occupy a relatively small portion or area of the usable space of pier 2. Furthermore, system 5 is configured to occupy a relatively small volume and be compact for easy storage in a boat, deck or pier 2 storage box, and/or elsewhere.

Referring now to FIGS. 1-4, base 10 includes a bottom wall 12 that can sit directly upon an upper surface of pier 2 during use. Bottom wall 12 can have any of a variety of suitable perimeter shapes. Although bottom wall 12 defines a relatively small footprint or occupies a relatively small portion of the usable space of pier 2, preferably, bottom wall 12 has dimensions and a corresponding surface area large enough to mitigate instances of use-induce marring, gouging, or other impact or pressure induced damage to pier 2. Stated another way, an interface between bottom wall 12 and the upper surface of pier 2 is large enough to suitably dissipate use-induced forces through the pier 2, preventing localized applications of such forces through the pier 2 which could gouge or otherwise damage the upper surface thereof.

Particular dimensions and perimeter shape of bottom wall 12 (and, of course, other components) are selected based on the intended end use of system 5. Implementations of system 5 that are used for mooring personal watercraft can be relatively smaller than implementations of system 5 that are used for mooring full-cabin cruiser vessels. For typical implementations, bottom wall 12 has a length of about 6-8 inches, a width of about 10-14 inches, and a thickness of about 3/16 inch, for example 6"×12"×3/16". Preferably, bottom wall 12 is made from a lightweight corrosion resistant material such as aluminum, stainless steel, or other suitable metallic materials.

Figure 4:
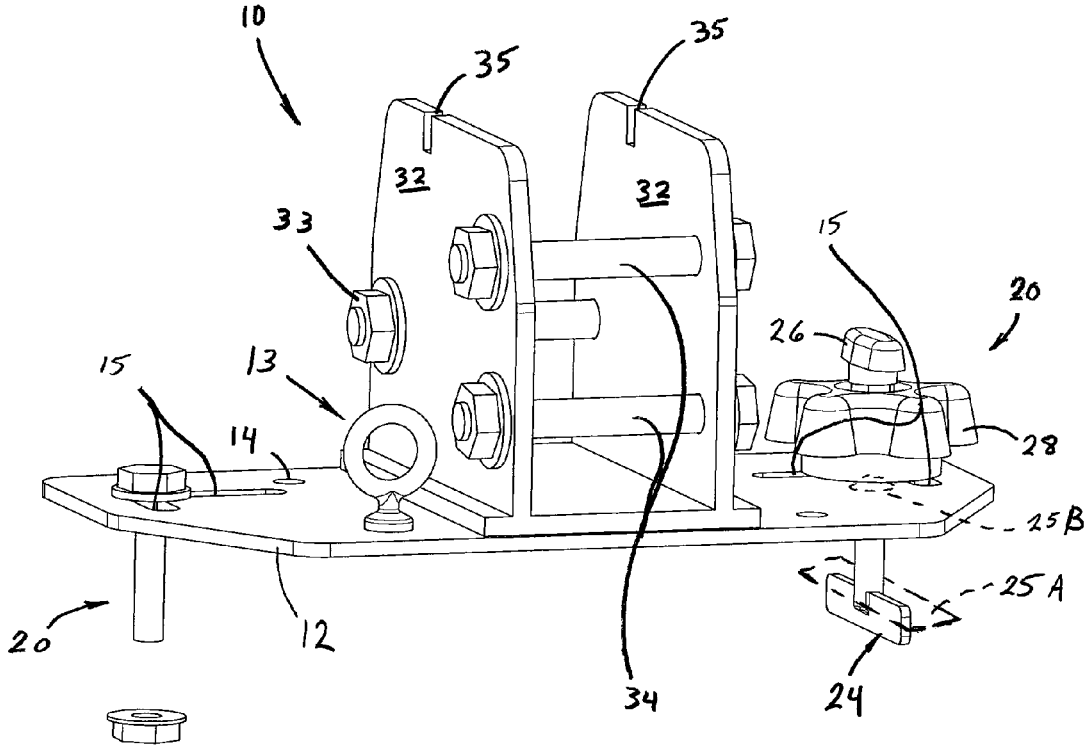
FIG. 4 is a pictorial view of an embodiment of a lower arm of the system of FIG. 1.

Referring now to FIG. 4, bottom wall 12 can include one or more eye bolts 13 or other structure(s) to which various boating or sporting accessories, such as mooring bumpers, minnow buckets, and others, can be tied or otherwise attached. Bottom wall 12 can also include multiple throughbores 14 and also elongate slots 15 to facilitate mounting the base 10 and thus also system 5 to the pier 2. Various ones of the throughbores 14 and/or elongate slots 15 can be selected for mounting use base on, e.g., the particular configuration of hardware assembly 20 as well as characteristics of pier 2.

Elongate slots 15 can extend longitudinally or transversely along the bottom wall 12, and allow variability or adjustability of mounting hardware positioning, thereby accommodating mounting the system 5 to piers having any of a variety of different decking plank widths or other mounting substrate configurations. This makes the system 5 easily adaptable and mountable to different pier 2, as desired. If both longitudinal and transverse elongate slots 15 are implemented, they can be separate and distinct from each other or can intersect each other to form a T-shaped or L-shaped perimeter.

Figure 3:
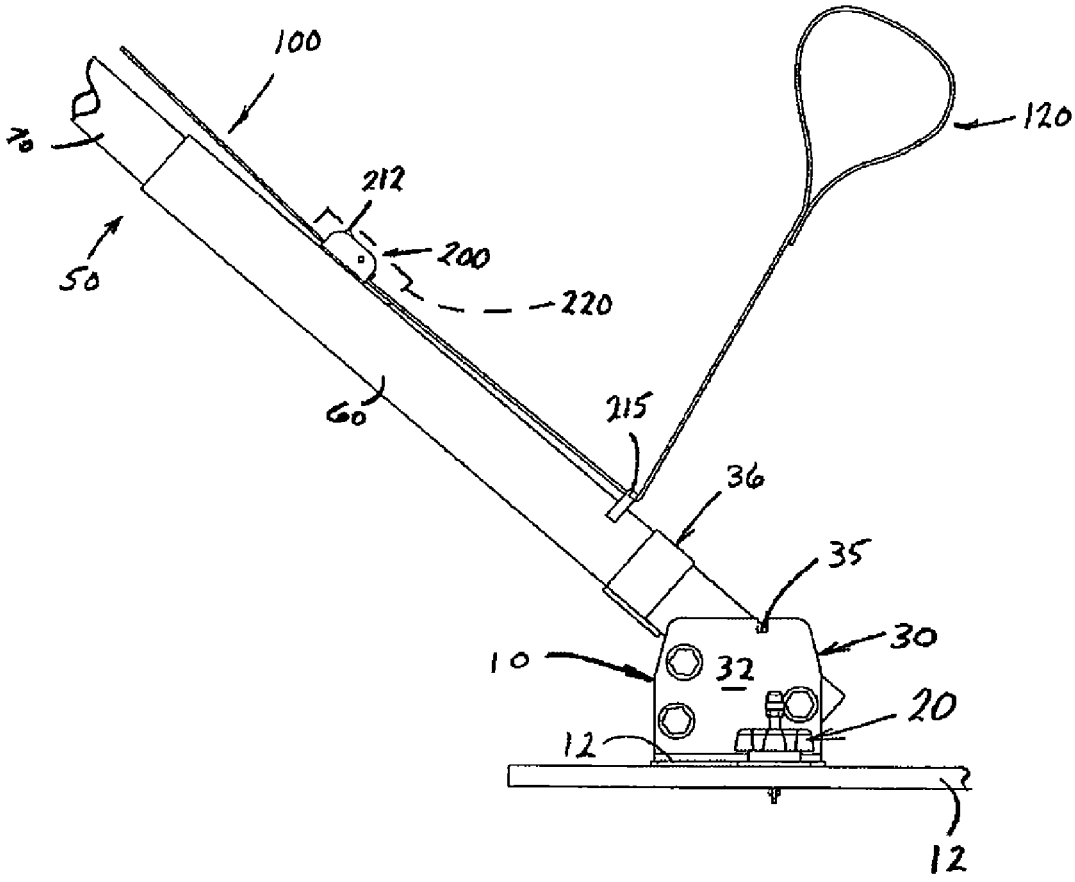
FIG. 3 is a pictorial view of an embodiment of an upper arm of the system of FIG. 1.

Referring now to FIGS. 2-4, bottom wall 12, and thus also base 10 and system 5, is attached to pier 2 by way of a hardware assembly 20. In some implementations, hardware assembly 20 includes conventional hardware. Such conventional hardware, such as for example, carriage or other bolts, washer, nuts, screws, or others can be used to permanently fix the system 5 to a pier 2. The word "permanently" can be understood and refer to mounting the system 5 to pier 2 in a manner that requires hand tools and/or power tools to remove the system 5 from pier 2. A conventional hardware setup, including a conventional bolt and flange-nut, can be seen on the left side of the base 10 as viewed in FIG. 4.

In yet other implementations, it is desired that system 5 has fully portable functionality, allowing it to be easily mounted to and unmounted from the pier 2, as desired. In such portable implementations, hardware assembly 20 is a fully tool-less hardware assembly requiring no hand tools or other tools to install. This allows users to install the system 5 by using only their hands, by manually actuating various components of the hardware assembly 20.

Referring again to FIG. 4, tool-less hardware assembly 20 which can be seen on the right side of the base 10 (as viewed in FIG. 4) includes a threaded rod 22 that extends through the bottom wall 12, either through a throughbore 14 or slot 15, depending on the particular end-use configuration. A projection 24 can extend radially or otherwise from a lower end of threaded rod 22. The projection can have a width dimension that is less than a distance between adjacent decking planks on pier 2. This allows the projection 34 and threaded rod 22 to insert through the space or gap between such adjacent planks, and correspondingly allows the system 5 to be mounted to pier 2 while the installer or user remains entirely above an upper surface of pier 2, during the entire installation procedure.

In some implementations, a paddle 25A is placed atop projection 24. Paddle 25A increases the surface area of the interface between projection 24 and a lower surface of pier 2, reducing the likelihood of non-desired penetration of projection 24 into the pier 2. Stated another way, the tool-less hardware assembly 20, the projection 24 and/or paddle 25A define an interface segment that presses against the lower surface of the pier 2. In lieu of or in addition to paddle 25A, one or more biasing washers 25B can be provided with the hardware assembly 20, for example between thumbscrew 28 and the upper surface of bottom wall 12 to mitigate loosening of the hardware assembly 20 if the projection 24 penetrates the lower surface of pier 2 over time. In other words, if the projection 24 embeds in the pier, a clearance is established between the bottom wall 12 of base 10 and the thumb nut 28. Biasing washers 25B occupy such clearance and urge the thumb nut 28 away from the bottom wall 12 so that no perceptible looseness or slop is established within the hardware assembly 20. Biasing washers 25B can be any of a variety of suitable hardware that can be resiliently compressed and tend to restore upon lessening of an input pinch force. Exemplary suitable hardware includes but is not limited to, e.g., wave washers, and/or other resilient or biasing-type washers.

Still referring to FIG. 4, and the tool-less hardware assembly 20, a cap 26 can sit atop and be attached and locked to threaded rod 22. This allows the threaded rod 22 and cap 26 to rotate in unison with each other. In this regard, by way of cap 26, a user can manually rotate the threaded rod 26 from above the upper surface of pier 2 to, for example, rotate the projection 24 to a desired position or orientation under the pier 2. Cap 26 can also be used to prevent non-desired rotation of the threaded rod 22 from above the upper surface of the pier 2 to, for example, hold and maintain the projection 24 in such desired position or orientation. While using cap 26 to hold projection 24 in such desired position or orientation, a knob or thumb nut 28, which is threaded upon the threaded rod 22, can be tightened down upon the threaded rod 22. Doing so axially advances the threaded rod 22 through the thumb nut 28, which correspondingly pulls the projection 24 upwardly against the lower surface of pier 2. In this manner, tool-less hardware assembly pinches or clamps the base 10 against the upper surface of pier 2 by squeezing and sandwiching the decking planks of pier 2 between the bottom wall 12 of base 10 and the projection 34.

Referring again to FIGS. 2-4, a flange assembly 30 extends upwardly from the bottom wall 12 and is configured to hold an end of arm assembly 50 so that can move, e.g., pivot, with respect thereto. Flange assembly 30 can include first and second flanges 32 that are generally planar upright projections and are spaced from each other. A bolt 33 extends through the flanges 32, serving as a pivot pin that holds an end of arm assembly 50, allowing it to pivot thereabout. In this configuration, an angle defined between the arm assembly 50 and pier 2 can be varied by pivoting the arm assembly about the bolt 33.

Flanges 32 can further have multiple holes that are aligned with each other, allowing bolts 34, or other supporting devices, to extend through respective pairs at different heights relative to the pier 2. The different vertical distances between bolts 34 and pier 2 at least define different use positions or angles, e.g., angles of inclination, of the arm assembly 50. The use angles or angles of inclination of arm assembly 50 are established by a lower surface of the arm assembly 50 sitting upon the bolt 34, whereby the bolt 34 serves as a downward pivot limiting stop for the arm assembly 50. Accordingly, by implementing bolt 34 at different heights, arm assembly 50 can be implemented at the desired angle, for example, horizontal and parallel to the pier 2, about 30 degrees with respect to the pier 2, about 45 degrees with respect to the pier 2, about 60 degrees with respect to the pier 2, or others.

Still referring to FIGS. 2-4, one or both of flanges 32 can include a locking structure such as slot 35 that cooperates with a locking collar 36 on the arm assembly 50 to hold the arm assembly 100 in a desired position, e.g., a retracted position or upwardly stored position (seen in dashed-outline in FIG. 2). In some implementations, slots 35 extend into an upper edge of the flanges 32. Locking collar 36 can extend about an entire perimeter of the lower end of arm assembly 50 and freely slide longitudinally upwardly and downwardly over the arm assembly 50. In this configuration, arm assembly 50 can be pivoted to an upright position, whereby locking collar 36 freely slides down the arm assembly such that a plate or lip of the locking collar 36, which may extend outwardly beyond the remainder of locking collar 26, slides downwardly into the slots 35. This locks the arm assembly 50 in the upright position since the arm assembly 50 is unable to pivot about bolt 33 when the locking collar 36 is engaged in the slots 35, whereby the locking collar 36 must be withdrawn from the slot 35 to restore the pivoting functionality of the arm assembly 50.

Referring again to FIG. 2, arm assembly 50 includes a lower arm 60 and an upper arm 70 that cooperate with each other to define an adjustable length of arm assembly 50 that can facilitate adjusting a particular configuration of system 5 to correspond to a particular boat 1, pier 2, or other end use factors and considerations. Lower arm 60 is an elongate and rigid member, having a lower end that is pivotally mounted, by way of bolt 33, to the flange assembly 30, and which houses the locking collar 36 thereupon. An upper end of lower arm 60 can include an opening which opens into an internal cavity of the lower arm 60. Such internal cavity can slidingly receive and house the upper arm 70 therein. In this configuration, the upper arm 70 can telescope with respect to the lower arm 60, varying the overall length of the arm assembly 50.

Still referring to FIG. 2, a knob or thumbscrew 75 can be used to fix or establish the overall length of arm assembly 50 by, e.g., locking the upper arm 70 with respect to lower arm 60. For example, thumbscrew 75 can thread through a sidewall of lower arm 60 and serve as a setscrew that holds upper arm 70 in place.

Referring again to FIGS. 1 and 2, an end of upper arm 70 that is furthest from pier 2 can include a line guide assembly 80. Line guide assembly 80 can include first and second pins 82 through which mooring line 100 passes. With pins 82 positioned above and below mooring line 100, it is kept from falling out of the guide assembly 80 during use.

Figure 5:
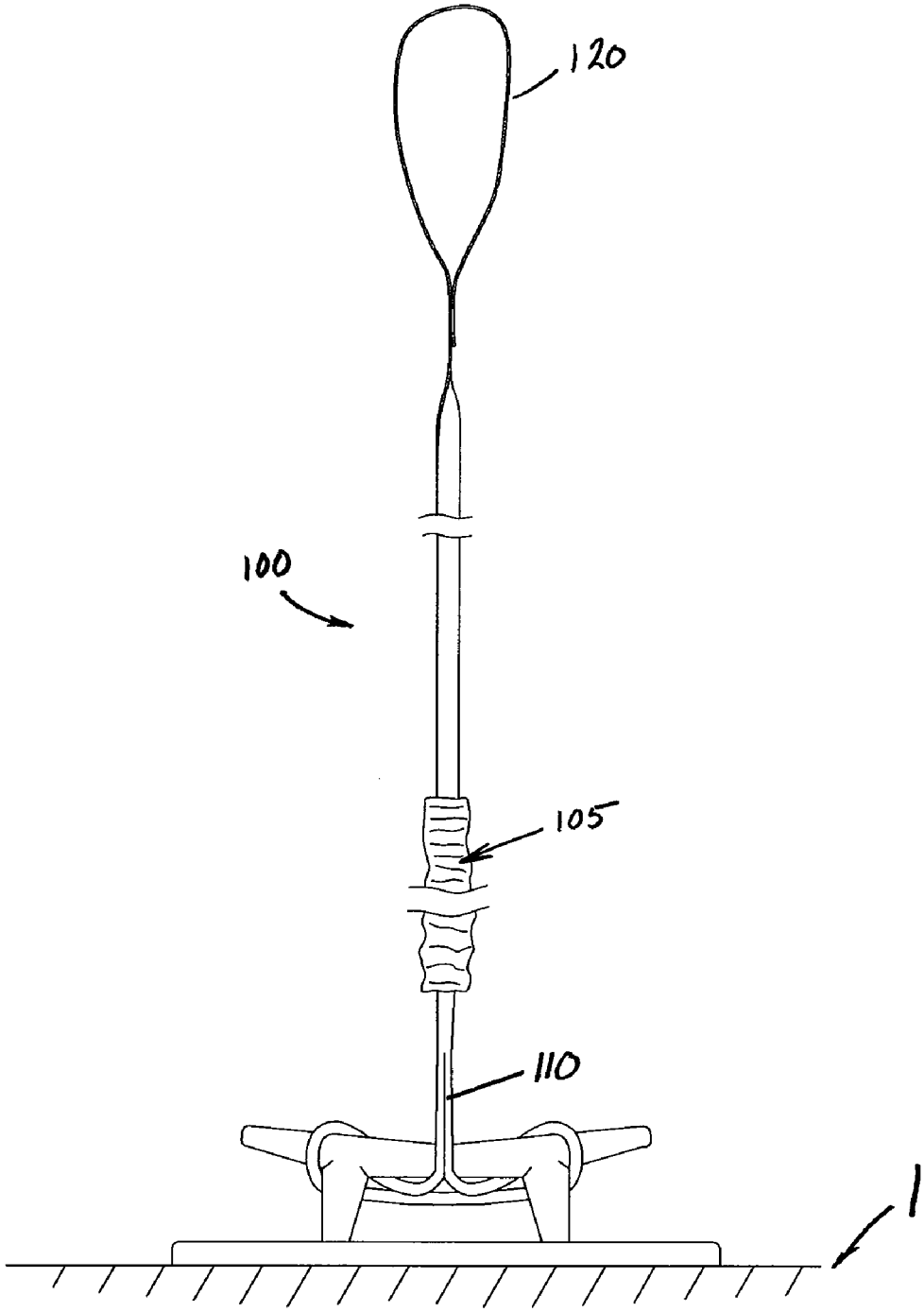
FIG. 5 is a front and side elevations of an embodiment of a mooring line according to the invention, usable with the system of FIG. 1.

Referring now to FIGS. 1 and 5, mooring line 100 includes a resiliently flexible segment, e.g., flexible segment 105, between first and second ends 110, 120 either or both of which can include a loop or other attaching structure as desired. The flexible segment 105 resiliently elongates and contracts to accommodate wave induced, user induced, or other movements of the boat while the boat is moored to the pier 2. In this configuration, flexible segment 105 can divert a majority of the stresses and movement loads away from base 10 and arm assembly 50, along with relieving corresponding stresses from the dock or pier 2 to which system 5 is mounted. In other words, flexible segment 105 serves as a shock absorber for the entire system 5. Furthermore, it is noted that purposefully tensioning (e.g., pretensioning) the flexible segment 105, can suitably stabilize the boat 1 in conditions of wind, waves, current, tide, or other outside forces such as a person(s) embarking or disembarking.

Referring now to FIGS. 1, 2, 3, and 5, such purposeful tensioning can be accomplished by cooperatively using mooring line 100 with an anchoring device 200. Anchoring device 200 may be provided in any of a variety of suitable locations upon the system 5, such as upon base 10 or arm assembly 50 (seen in FIGS. 1, 2, and 3). Anchoring device 200 can be used to establish or adjust a resting state length of mooring line 100. The resting state length of mooring line 100 is defined between (i) anchoring device 200, and (ii) an end of the mooring line that extends beyond the arm assembly, for example, the end attached to boat 1. In other words, anchoring device 200 allows a user to, without tools, pay out or draw in an amount of mooring line 100 depending on whether it is desired to lengthen or shorten the amount of mooring line 100 that extends beyond guide assembly 80. It is noted that if the mooring line 100 is attached to boat 1 by a cleat or otherwise, then shortening the amount of mooring line 100 that extends beyond guide assembly 80 can place the flexible segment 105 of mooring line 100 in a state of tension.

Still referring to FIGS. 1, 2, 3, and 5, anchoring device 200 can include a cam buckle 210 that has a spring biased cam or is otherwise configured to allow the mooring line 100 to be freely pulled in a first direction therethrough, while not allowing it to be pulled therethrough in a second direction. Cam buckle 210 also includes a thumb lever 212 that is operatively coupled to the cam so that by depressing the thumb lever 212, the mooring line 100 is allowed to free float in either direction through the cam buckle 210. With the thumb lever 212 released, the mooring line 100 is held in its set position by a gripping action provided by the cam buckle 210. In this configuration, the cam buckle 210 will automatically hold the mooring line 100 at an established resting state length and/or in a state of tension.

Referring specifically to FIG. 3, in some implementations, anchoring device 200 includes both cam buckle 210 and also loop 212. Loop 212 can be attached to the lower arm 60 and aligned with the cam buckle 210. In this configuration, mooring line 100 can extend through the cam buckle 210 and the loop 212 in series, allowing the loop 212 to serve as a point of redirection when pulling the mooring line 100. In this regard, loop 21 can redirect the mooring line 100 such that a pulling force that pulls a first segment of the mooring line 100 in a first direction correspondingly pulls a second segment of the mooring line through the cam buckle 212 in a second, different direction, as indicated by the arrows of FIG. 3.

Still referring to FIG. 3, in lieu of cam buckle 210, the anchoring device 200 can include a ratcheting assembly 220. Ratcheting assembly 220 can be largely analogous to those provided on conventional, e.g., ratcheting tie-down straps or other ratcheting devices that can winch in an elongate web of material. Accordingly, ratcheting assembly 220 includes a spool with a slot extending radially therethrough, through which the mooring line 100 extends. A handle of the ratcheting assembly 220 is actuatable for rotating the spool in a first direction and correspondingly rolling a respective portion of the mooring line 100 thereupon, winching or retracting the line 100 in the process. Ratcheting assembly 220 further includes a release mechanism to allow the spool to freely rotate in a second direction for paying out the mooring line 100.

In light of the above, to use the system 5, a user evaluates a potential mounting substrate such as pier 2 and decides upon a mounting method, e.g., whether permanently or tool-less releasably mounting of the system 5 is desired. For permanent mounting, the user utilizes appropriate tools and conventional hardware to secure the bottom wall 12 of base 10 to the pier 2. Portable implementations in which the system 5 is releasably mounted may require utilization of the tool-less hardware assembly 20. For example, projections 24 are aligned with and inserted through spaces between adjacent decking planks, by adjusting relative positions of threaded stems 22 within slots 15 to correspond to a distance between respective spaces of the pier 2.

Cap 26 is rotated to correspondingly rotate the threaded stem 22 and projection(s) 24 to prevent its withdrawal from between the adjacent decking planks. When the projection 24 is in the desired position, cap 26 is held in a fixed position while the knob or thumbscrew 28 is tightened down along the threaded stem 22, pulling the projection upwardly against the lower surface of pier 2.

Height and/or other characteristics of boat 1 and pier 2 are evaluated. Based on such evaluation, bolt(s) 34 is positioned within a corresponding pair of aligned holes in the flange assembly 30 to provide the desired angle of inclination of arm assembly 50. Locking collar 36 is withdrawn from slots 35 and arm assembly 50 is pivoted down against the bolt 34. Knob or thumbscrew 75 is loosened and the length of arm assembly 50 is adjusted by establishing a desired longitudinal position of upper arm 70 with respect to lower arm 60.

An end of mooring line 100 is attached to, e.g., a cleat of boat 1 and the other end is passed through guide assembly 80 and anchoring device 200. Anchoring device 200 is then used to create tension in the flexible segment 105 or elsewhere in mooring line 100. This can be done by passing an end of the mooring line 100 through loop 212 and pulling the end so that a length of the mooring line 100 is drawn through cam buckle 210. When the user stops pulling, the cam buckle 210 automatically holds the mooring line 100 at such established length and therefor also maintaining its tension. For ratchet assembly 220 implementations, the ratchet handle is actuated to draw in the mooring line to the desired length and tension.

Such procedures are preferably repeated on a second system 5 to moor boat 1 by securing multiple portions thereof to pier 2. Furthermore, the above-discussed procedures can be generally reversed to release boat 1 from being moored to pier 2. For portable uses of system 5, when boat 1 is released, the system 5 can be fully uninstalled and removed from the pier 2. The system 5 can then be fully collapsed by, e.g., sliding upper arm 70 fully into lower arm 60, reducing the overall size of system 5 and facilitating its storage either on boat 1 or off from boat 1.

Although the best mode contemplated by the inventors of carrying out the present invention is disclosed above, practice of the present invention is not limited thereto. It will be manifest that various additions, modifications, and rearrangements of the features of the present invention may be made without deviating from the spirit and scope of the underlying inventive concept. Moreover, the individual components need not be formed in the disclosed shapes, or assembled in the disclosed configuration, but could be provided in virtually any shape and assembled in virtually any configuration. Furthermore, all the disclosed features of each disclosed embodiment can be combined with, or substituted for, the disclosed features of every other disclosed embodiment except where such features are mutually exclusive.

It is intended that the appended claims cover all such additions, modifications, and rearrangements, whereby various alternatives are contemplated as being within the scope of the following claims particularly pointing out and distinctly claiming the subject matter regarded as the invention.

We hereby claim:

1. A portable boat mooring system, comprising:

a base removably attached to a pier, an arm assembly defining a length thereof and having a first end that is attached to the base and overlies the pier and a second end extending away from the first end of the arm assembly, outwardly beyond an edge of the pier;

a mooring line attached to and extending (i) along at least a portion of the length of the arm assembly, and (ii) beyond the arm assembly and having an end that attaches to a boat for securing the boat to the pier while maintaining a space between the boat and the edge of the pier, wherein at least a portion of the mooring line is resiliently flexible, elongating and contracting to accommodate wave-induced movements of the boat while the boat is secured to the pier;

the mooring line further comprising an end that loops through a cleat of the boat while securing the boat to the pier, and wherein the mooring line defines an adjustable resting state length defined between (i) an anchoring device that selectively anchors a portion of the mooring line to at least one of the arm assembly and the base, and (ii) an end of the mooring line that extends beyond the arm assembly; and wherein the anchoring device includes a ratcheting assembly.

2. A portable boat mooring system comprising:

a base removably attached to a pier;

an arm assembly extending from the base outwardly beyond an edge of the pier for maintaining a space between the boat and the edge of the pier;

a mooring line extending between and securing a boat to the arm assembly; and a tool-less hardware assembly extending between and engaging each of the base and the pier, wherein manual actuation of the tool-less hardware assembly clamps the base against the pier, removably attaching the base thereto; and wherein the tool-less hardware includes:

a threaded rod extending through the base, the threaded rod having a cap on an end thereof for manually rotating the threaded rod from above an upper surface of the pier and preventing non-desired rotation of the threaded rod from above the upper surface of the pier; and a thumb nut engaging the threaded rod such that tightening the thumb nut upon the threaded rod clamps the bottom wall of the base against the pier.

3. The portable boat mooring system of claim 2, wherein the tool-less hardware assembly includes an interface segment that presses against a lower surface of the pier.

4. The portable boat mooring system of claim 2, the threaded rod extending upwardly from the interface segment.

5. The portable boat mooring system of claim 4, wherein the interface segment has a width dimension that is less than a distance defined between adjacent decking planks of a pier upon which the portable boat mooring system is mounted.

6. The portable boat mooring system of claim 2 wherein the base includes a bottom wall with at least one elongate slot accepting the tool-less hardware therethrough and facilitating mounting the portable boat mooring system to multiple pier decking planks having different width dimensions.

7. The portable boat mooring system of claim 6 wherein the at least one elongate slot includes a longitudinally extending slot and a transversely extending slot and defining a variable mounting depth and a variable mounting width, respectively, of the base.

8. A portable boat mooring system, comprising:

a base removably attached to a pier;

an arm assembly extending from the base outwardly beyond an edge of the pier for maintaining a space between the boat and the edge of the pier, a mooring line extending between and securing a boat to the arm assembly; and a tool-less hardware assembly extending between and engaging each of the base and the pier, wherein manual actuation of the tool-less hardware assembly clamps the base against the pier, removably attaching the base thereto; and a locking collar that cooperates with a flange assembly, the locking collar being configured for holding the arm assembly in a retracted position in which the arm assembly does not extend outwardly beyond the edge of the pier when the locking collar engages the flange assembly.

9. The portable boat mooring system 8 wherein the flange assembly includes a pivot pin and a pivot limiting stop that extend horizontally across the flange assembly;

wherein the arm assembly is attached to a pivot pin so as to pivot with respect to the flange assembly between (i) a retracted position in which the arm assembly is held upwardly away from the body of water, and (ii) an in-use position is which the arm assembly leans against the pivot limiting stop; and wherein the pivot pin is positioned on the flange assembly such that when the arm assembly is in the in-use position, the arm assembly extends angularly upward from the base.

* * * * *